US007488882B2

(12) United States Patent
Curet Troche

(10) Patent No.: US 7,488,882 B2
(45) Date of Patent: Feb. 10, 2009

(54) DRUM

(75) Inventor: Daniel Loran Curet Troche, Rochester, NY (US)

(73) Assignee: D. Loran Curet Troche, Philadelphia, PA (US)

( * ) Notice: Subject to any disclaimer, the term of this patent is extended or adjusted under 35 U.S.C. 154(b) by 0 days.

(21) Appl. No.: 11/593,579

(22) Filed: Nov. 7, 2006

(65) Prior Publication Data

US 2008/0121088 A1 May 29, 2008

(51) Int. Cl.
*G10D 13/02* (2006.01)
*G10D 13/04* (2006.01)

(52) U.S. Cl. ..... 84/411 R; 84/413; 84/419

(58) Field of Classification Search ..... 84/411 R, 84/419, 413

See application file for complete search history.

(56) References Cited

U.S. PATENT DOCUMENTS

| | | | | | |
|---|---|---|---|---|---|
| 1,755,569 | A * | 4/1930 | Strupe | 84/419 |
| 1,845,625 | A * | 2/1932 | Robison | 84/419 |
| 3,008,367 | A * | 11/1961 | Parsons | 84/725 |
| 3,188,687 | A * | 6/1965 | Blair | 425/394 |
| 3,290,979 | A * | 12/1966 | Glass et al. | 84/104 |
| 3,685,389 | A * | 8/1972 | Bemben | 84/411 R |
| 4,048,895 | A * | 9/1977 | May | 84/411 A |
| 4,112,807 | A * | 9/1978 | Quibell | 84/411 R |
| 5,610,350 | A * | 3/1997 | Miller | 84/413 |
| 6,441,286 | B1 * | 8/2002 | Brando et al. | 84/411 R |
| 7,288,707 | B2 * | 10/2007 | Swinkels | 84/411 R |
| 2008/0034944 | A1 * | 2/2008 | Aspland | 84/415 |
| 2008/0083317 | A1 * | 4/2008 | Payerl | 84/411 R |
| 2008/0121088 | A1 * | 5/2008 | Curet Troche | 84/413 |

FOREIGN PATENT DOCUMENTS

GB 3332 0/1810

OTHER PUBLICATIONS

Sebastian Erard, biography, inventor of the pedal harp in 1810, http://www.pianorestaurateur.nl/erard_biografie.htm, viewed Dec. 14, 2007.*

Pianoforte, reference to Sebastian Erard, Encyclopedia Britannica, published 1907 by the Werner, Company, Akron, Ohio., p. 83.*

Harp History, Double Action Harp description, invented in 1810 by Sebastian Erard, p. 2; also photo of a rare Erard Freres (brothers) harp, showing pedals for note changing, http://www.vanderbiltmusic.com/harp_history.php, viewed Dec. 14, 2007.*

* cited by examiner

*Primary Examiner*—Walter Benson
*Assistant Examiner*—Robert W Horn
(74) *Attorney, Agent, or Firm*—Gerald J. Cechony

(57) ABSTRACT

An improved drum includes a substantially cylindrical drum shell having a drum head and containing a mechanical voice system including strings, and a mechanical tuning system for adjusting tension of the drum head and the strings, and a spring housing serving as a base of the drum and containing shock absorbers, base extensions for stability, and pedals for mechanical note changes.

21 Claims, 4 Drawing Sheets

Fig. A
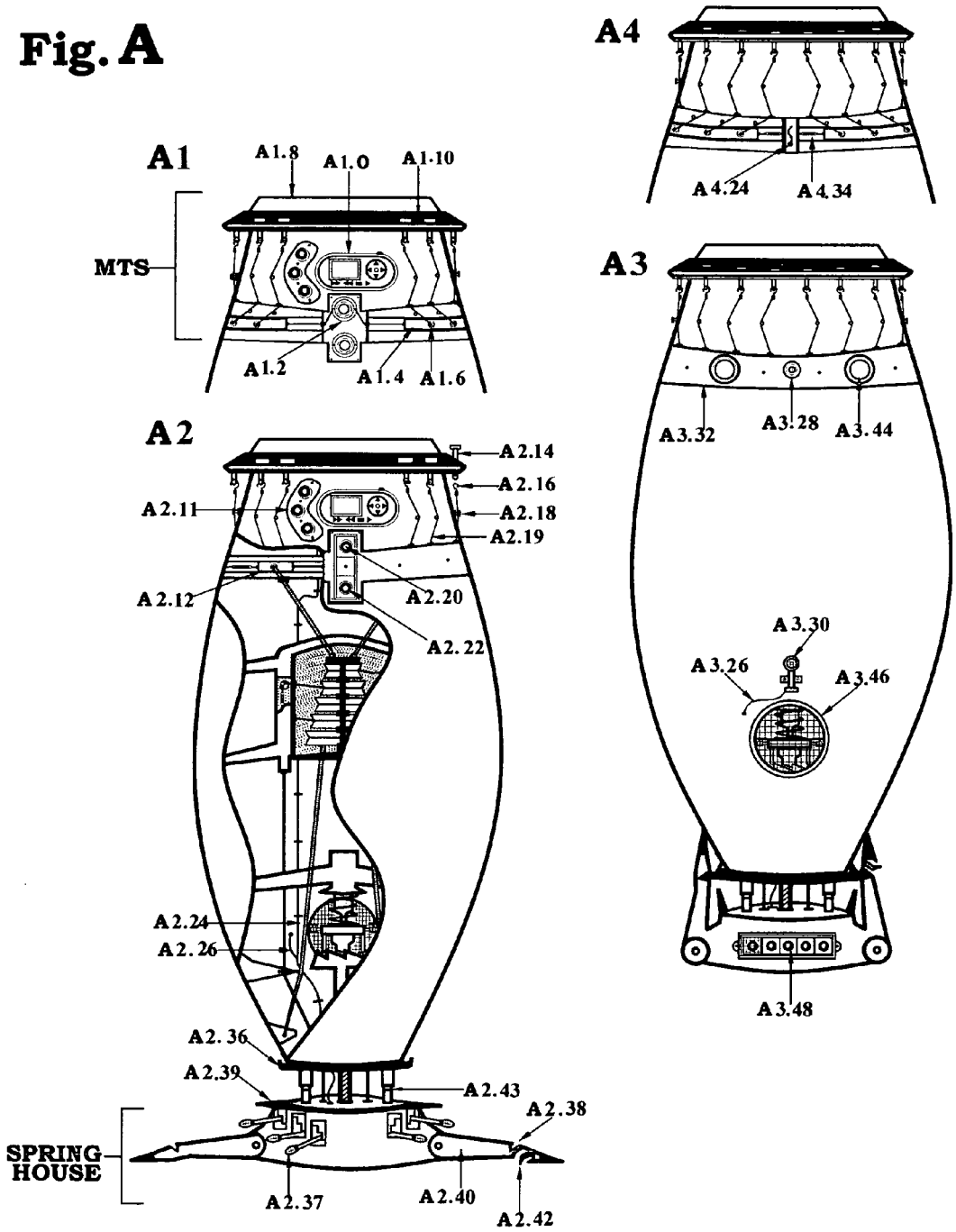

Fig. B
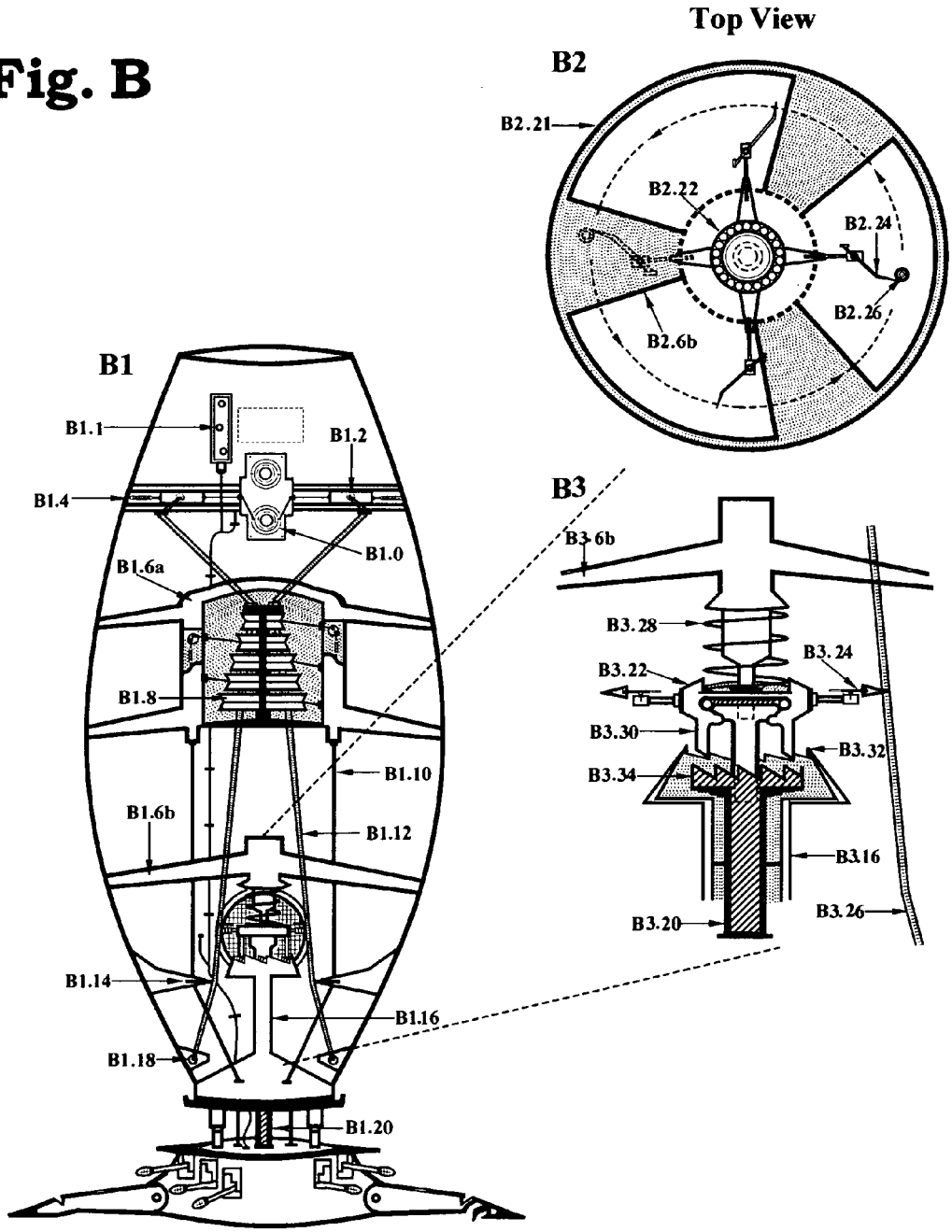

Fig. C
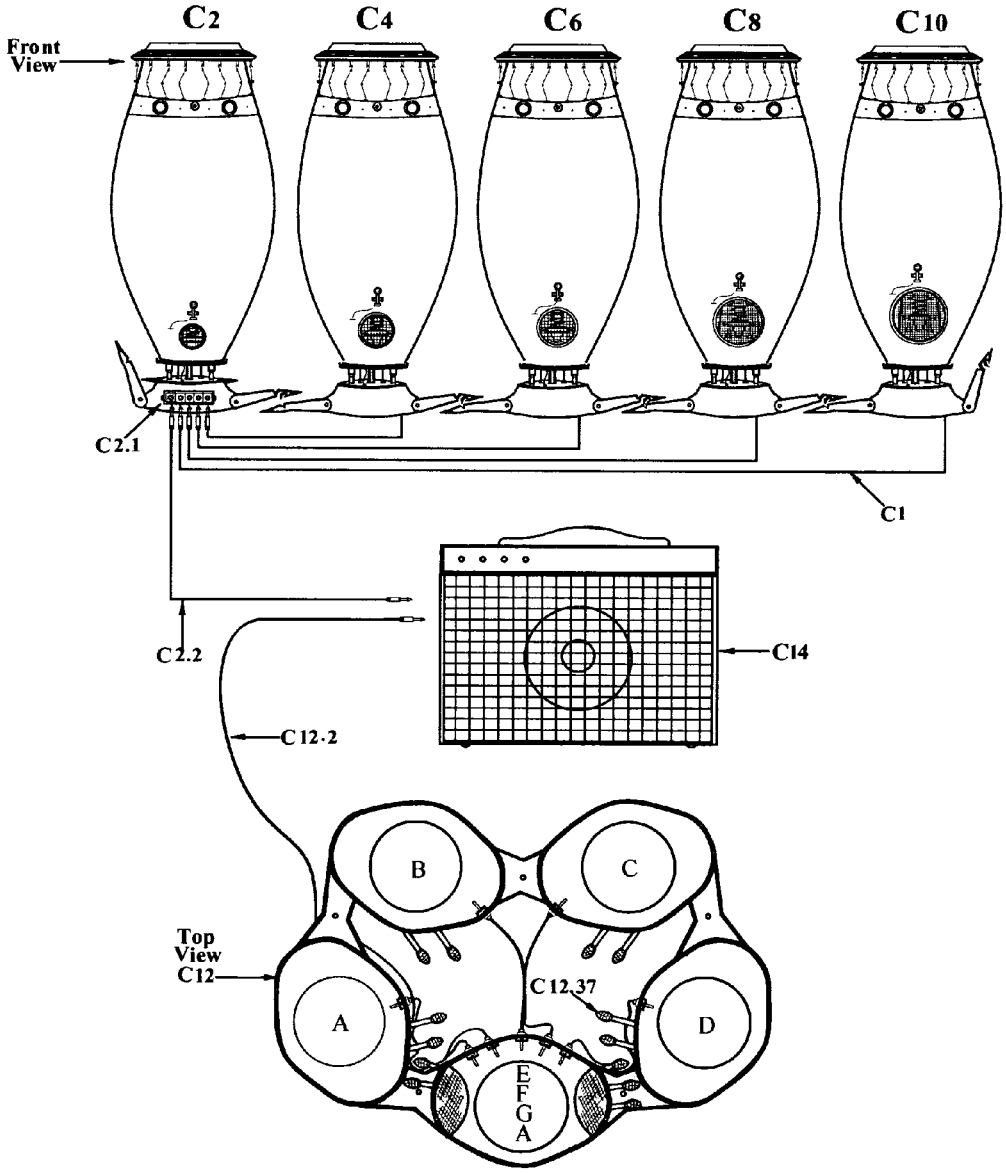

Fig. D
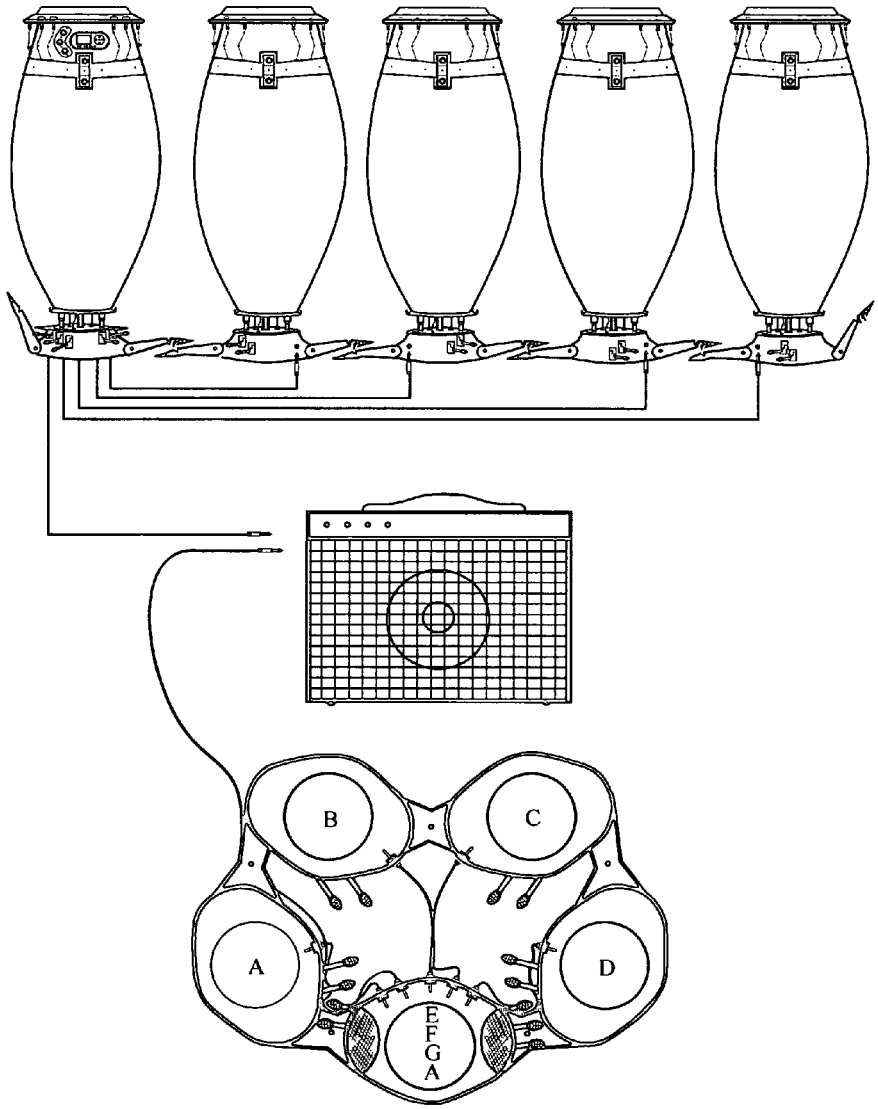

DRUM

BACKGROUND OF THE INVENTION

1. Field of the Invention

This invention pertains to musical instruments, particularly to drums, and most particularly to conga drums.

2. Related Art

The pedal system in the drum for control of the mechanical voice system of strings has been used for many years since the invention of the harp. The mechanism and use of these pedals for musical tone changes and sound control are described in the "double movement" or "double-action" pedal system in the UK Pat. No. 3332, patented May of 1810, by Sebastian Erard.

U.S. Provisional Patent Application No. 60/736,182, filed Nov. 14, 2005.

In the Sachs-Hornbostel system of musical instrument classification known to those skilled in the art, a conventional conga drum is classed as a membranophone, since its main means for producing sound is the vibration of tightly stretched membrane. A conventional conga drum is thus limited to the range of sounds producible by a membranophone.

Hand percussionists in particular may experience hand trauma due to repetitive physical impact while drumming. Bone structure and soft tissue changes typically occur, leading to poor blood and oxygen supply, nerve damage, callus formation and even bone fractures in cases of aggressive inexperienced hand drummers. Transport of heavy instruments is also often a challenge to percussionists. Drum shells of hand percussion instruments such as congas are often made of heavy wood, metal, or fiberglass, necessary to provide sturdiness and resistance to cracking during percussion.

BRIEF SUMMARY OF THE INVENTION

The improved conga drum of the present invention (trade name "Acousticonga") overcomes these drawbacks of the prior art by providing:

a central framework for imparting strength and rigidity to the conga drum allowing the drum shell to be made of lightweight material;

a voice system mounted to the central framework and comprising chordophone strings for extending the musical range of the conga drum;

a spring house for cushioning mechanical shock thus reducing trauma to a hand percussionist; and a mechanical tuning system for aiding in tuning the membrane and the strings, thus enhancing the musical range of the conga drum. These and other advantages of the improved drum will be apparent after reviewing the ensuing description and the appended drawings, wherein:

BRIEF DESCRIPTION OF THE DRAWINGS

FIG. A depicts the mechanical tuning system (MTS) for drumhead and strings, and spring housing shock absorption system with pedals for musical note control.

FIG. B depicts the mechanical voice system (MVS) of strings and striker action mechanism for string vibration.

FIG. C shows a front view, top view and Amplification system of conga drums according to the present invention;

FIG. D is a back view of conga drums according to the present invention.

DETAILED DESCRIPTION OF THE INVENTION

This musical instrument is composed of multiple parts including the mechanical voice system (MVS). The MVS (FIG. B) is composed of a central framework (B1.6*a*, B1.6*b*, B2.6*b*, B3.6*b*) which serves as the anchor for the different components of the MVS as well as the spring housing (FIG. A) and the mechanical tuning system (MTS) (FIG. A). The musical strings originate on inner sliding plates (A2.12), components of the mechanical tuning system located toward the end of the shell where the drumhead is placed. The strings then travel centrally away from the outer shell and through the central framework (B1.6*a*, B1.6*b*, B3.6*b*). These strings continue to travel downward, away from the drumhead and outward from the center (B1.12), eventually traveling over a fork on a circular bridge (B1.14). The forks serve to help maintain high levels of tension on the strings for their necessary vibration. After the strings pass over the bridge, they angle outward from the center to attach to a finger pin (B1.18) on the outer shell. A variety of strings including different thicknesses and/or materials may be chosen to be placed around the circumference of the bridge. Different desired pitches and tones may be attained with vibration of the strings upon percussion of the drumhead. For example, each separate mechanical voice system may be set up to represent a different musical key, allowing each shelled instrument to represent a different musical note (C12). The strings also have an automatic mechanical tuning system (FIG. A). The strings travel along the inner sliding plates previously mentioned (A2.12). These strings are pulled for tuning when a tuning dial is manually turned (A2.22). There are two tuning dials associated with the automatic mechanical tuning system, one for tightening the musical strings (A2.22) and another for tightening the drumhead (A2.20). There is a rim (A1.10) that pulls down on the drumhead (A1.8), by pulling down on another metal structure surrounding the drumhead. The rim also has circular openings throughout its circumference for cable anchors (A2.14) to travel through and pull down on the rim. A cable hook with associated pulley (A2.16, A2.18) serves to pull on the cable anchors. The tuning cables (A2.19) travel along the exterior of the drum shell on one set of two outer sliding plates (A1.4) opposite each other. The musical strings travel on the inner sliding plates mentioned previously. Movement of these sliding plates by the turning of the drumhead and string tuning dials subsequently increases or decreases the tension on the attached cables or strings. This said mechanical tuning system is constructed such that movement of the cables, strings and tuning dials can be performed with ease.

The spring housing is attached to the drum shell by way of the shock absorber columns (A2.43). The backbone (A2.35, B1.20, B3.20) extends upward from the spring housing into the center of the drum shell where the striker action is located, the mechanism which serves to strike the musical strings causing string vibration. Shock absorbers surround the entire mouth, or closed end if such design desired, opposite the drumhead. These shock absorbers serve to allow downward movement of the drum shell and central framework with every percussion strike of the drumhead. Upon downward movement of the drum shell the striker head (B2.24 and B3.24) of the striker action (FIGS. B2 and B3) which is partially stabilized on the said backbone (B1.20, B3.20), will directly strike the strings (B1.12, B2.26, B3.26) after a series of other sequential movements to be described. Part of the striker action is free floating and surrounding the backbone. It is weighted and pressured down by springs (B3.28) while being suspended upward in the neutral position by the jagged edges (B3.32), a component of the central shaft (B1.16, B3.16). In the neutral position the jagged edges suspend the striker shank (B2.22, B3.22) upward. When the drumhead is hit displacing the drum shell and central framework downward, the jagged edges are displaced downward as well, leaving the circular comb-edged structure (B3.34) in place to suspend the striker shank upward by its angular columns (B3.30). The circular comb (B3.34) is attached to the backbone (B3.20), both of which are completely stable during drumhead percussion. Therefore, either a circular comb-edged structure (B3.34) or surrounding jagged edges (B3.32), depending on which one is in the appropriate position, will push upward on the angular columns (B3.30) of the striker action. The circle of surrounding jagged edges (B3.32) are attached to the drum shell central framework by way of the central shaft (B1.16) and drum shell. The jagged edges surround the circular comb (B3.32, B3.34). When the mechanical voice system and central framework move downward with drumhead percussion, so do the attached jagged edges. Once the jagged edges are displaced downward the striker action drops slightly downward to then be suspended by the circular comb, specifically the tip of the circular comb teeth. Said teeth push upward on the striker action angular columns. The angular shape of the striker action columns cause the columns to slide slightly downward and to the side, off of the tip of the circular comb teeth. As soon as the jagged edges return back upward to their neutral position, they push the striker action angular columns back up to their original position. Due to the angular shape of the striker action columns and the shape of the jagged edges, the striker shank (B2.22, B3.22) rotates, sliding down the side of the jagged edges to finalize the full rotation of the striker action. The full rotation is necessary for the striker heads (B2.24, B3.24) to strike the adjacent strings (B2.26, B3.26). These sequential steps all occur almost immediately upon percussion of the drumhead. The applied pressure from the compressed springs above the striker action allow the rotational motion to occur with enough force to cause vibration of adjacent strings. Each striker head also serves to damp the sound immediately after striking the string by remaining on the string. This prevents over-resonance of the string vibration.

At the bottom of the spring housing are the base and attached extensions, known as the shoes (A2.40). These shoes, in addition to the base, serve to stabilize the instrument as a whole on the ground or floor. At the tip of the shoes are shoe hooks (A2.38) and shoe pins (A2.42) allowing for multiple shell percussion instruments to be anchored to each other. This serves to add further stability to these shell percussion instruments when standing side by side. The shoe hooks also serve to store away the shoes by folding them upward and hooking onto a closure pin above (A2.36). Attached to the base of this spring housing is a minimum of one pedal (A2.37, C12.37) per single unit. These pedals each have a connected cable (B1.10) which travels upward through the central framework eventually connecting to the scale gears (B1.8), which are string pulling devices. These scale gears of different sizes serve to pull on the strings producing flat, sharp and nature sound tones. The strings travel down and outward away from the drumhead and through openings in the different Circular scale gears, creating an angular direction of travel. This diagonal direction of travel allows for change in sound volume of the string vibrations when the striker action strikes the strings. The harder the drumhead is hit the more downward displacement there will be of the drum shell, central framework, and strings. As a result, the closer the striker head will get to the strings. The more contact there is between the striker action and the string, the louder the string vibration will be. There is a scale gear at different locations along the backbone, one for each pedal. One of the pedals has a different function from the rest. This function is to disable the striker action and the string sounds, leaving the drumhead and other sounds to be heard alone without the musical strings. Upon pressing one of the other pedals, the scale gears turn and pull on the strings in one direction such that the tone of the sound produced by the string vibration can be changed to flat, sharp, neutral, A, B, C, D, E, F, G, or on/off, depending on the pedal pressed.

In the conga drum shell design according to the present invention, the sound emitted due to drumhead percussion and string vibration travels out of the shell through a horn-like opening (A3.46) on the side of the drum shell. This horn formation will be of a different size, depending on the neutral pitch of the conga drum. The smaller the shell, the higher the conga drum pitch, and the smaller the horn formation will be. The end directly opposite the drumhead is closed allowing the sound to strictly be emitted through the horn formation. In addition, rattles, small bells or the like (A3.44) may be inserted into the side of the drum shell. These areas, where the rattles and such insert, have a cover to prevent sound from escaping from the drum shell when these items are not in use. There is also an incorporated slant angle in the construction of the drum shell in order to provide easy hand positioning without the need to tilt the drums. There is at least one high frequency microphone (A3.28) to emphasize the high frequency sounds created by the drumhead and a minimum of one low frequency microphone (A3.30) to emphasize the low frequency sounds from the horn-like opening (A3.46). These sounds are transmitted further by way of cables capable of connecting to an amplifier. Each conga drum has cable connectors (C1). One of the set of conga drums has the central connector (C2.1) from which the amplifier cable (C2.2) connects to the amplifier (C14). There are also volume, base and treble control knobs (A2.11, B1.1). Last but not least there is a removable digital tuner/MP3 player, AICLAVE, with rhythmic "clave" beats/tempo variations known to the Latin music genre.

The conga drum may be produced with a pick-up, known to those in the art, for transducing sound from vibration, particularly vibration of the strings, for further amplification. Dials are included for manipulation of sound, including volume and tone.

Although the above description has been directed to preferred embodiments of the invention, it will be understood and appreciated by those skilled in the art that other variations and modifications may be made without departing from the spirit and scope of the invention, and therefore the invention includes the full range of equivalents of the features and aspects set forth in the claims.

What is claimed is:

1. A musical instrument comprising:

an elongate drum shell of substantially circular cross-section with a drum head at a first end;

a mechanical voice system within the drum shell comprising a central framework, strings, stability plate means for string stability and tension maintenance, a bridge means for resonance transfer from the strings to the drum shell, circular gear means for changing string semi notes, and finger pin means for string attachment to the drum shell;

an automatic mechanical tuning system mounted to said drum shell around said drum head for tightening and loosening said drum head and strings within the drum shell, tightening and loosening said drumhead to provide changes in said drumhead pitch, and tightening and loosening said strings within drum shell to provide changes in string tension;

said automatic mechanical tuning system comprising:

tuning cables, tuning dials, sliding plates, and pulleys for ease of movement of said tuning cables, said sliding plates, and said tuning dial; and, a spring housing attached to a second end of the drum shell for standing the instrument on a floor and comprising a central backbone with a striker action for striking the strings so as to cause vibratory sound, and shock absorbers arranged to absorb impact axial to the drum shell.

2. In a musical instrument as claimed in claim 1, a striker action comprising circular scale gear means for pulling or tightening musical strings so as to produce different semitones.

3. The musical instrument as claimed in claim 1, wherein said mechanical voice system includes an electric pick-up for sound amplification.

4. The musical instrument as claimed in claim 1, wherein said drum shell includes one open end covered by a drumhead and another end covered by said spring housing, and said drum shell has a side opening for sound wave emission.

5. The musical instrument recited in claim 4 further comprising a second microphone proximate to the side opening for transducing sound waves from the side opening to electrical signals in a cable connected to an external amplifier.

6. The musical instrument recited in claim 5 wherein volume and tone controls are mounted on the drum shell connectable through the cable for adjusting operation of an external amplifier.

7. The musical instrument as claimed in claim 1, wherein said mechanical voice system includes a central framework serving as an anchor and encasement for said strings, said stability plates, said bridge, said circular gears, and said striker action;

and said central framework is made of a lightweight material.

8. The musical instrument as claimed in claim 1, wherein said mechanical voice system includes strings traveling from said automatic mechanical tuning system sliding plate and passing through one or more said stability plates, passing through said bridge means, and attaching to a finger pin on the drum shell.

9. The musical instrument as claimed in claim 1, wherein said striker action comprises a circular device with a means for striking said strings; and for remaining momentarily against said strings for damping string vibration.

10. The musical instrument as claimed in claim 1, wherein said striker action comprises circular scale gear means for pulling said strings so as to produce different semitones, and said strings angle from inside toward the outer shell giving rise to a diagonal direction of travel through the circular scale gears.

11. The musical instrument as claimed in claim 1, wherein said drumhead includes a letter drawing denoting the open note corresponding to said string tension in said mechanical voice system.

12. The musical instrument recited in claim 1 wherein the spring housing comprises pedals for musical note changes.

13. The musical instrument recited in claim 1 wherein the spring housing comprises base extensions for expanding the instrument's footprint so as to improve stability.

14. The musical instrument recited in claim 13 wherein the base extensions have outer ends adapted to engage with outer ends of base extensions of other similar instruments, whereby instruments may be mechanically interlocked.

15. The musical instrument recited in claim 1 further comprising a first microphone proximate to the drum head for transducing sound waves from the drum head to electrical signals in a cable connected to an external amplifier.

16. The musical instrument recited in claim 15 wherein volume and tone controls are mounted on the drum shell connectable through the cable for adjusting operation of an external amplifier.

17. The musical instrument recited in claim 1 wherein the drum shell tapers from a first diametric dimension at a portion not proximate to the drum head to a second substantially smaller diametric dimension proximate to the drum head, whereby:

the drum shell resonates a range of notes, the hand positions of a player striking the drum head are eased, and ability to strike the drum head without tilting the drum shell is facilitated.

18. A mechanical voice system for use in a musical instrument, comprising:

an outer drum shell, one or more ends, one end covered by a drum head for percussion, a central framework mounted within said outer drum shell, strings, stability plate means for stabilizing said strings and for tension maintenance, bridge means for resonance transfer from said strings to said outer shell, circular scale gear means for changing said string semi notes, and finger pin means for attaching said strings to the outer drum shell.

19. An automatic mechanical tuning system mountable on a musical instrument, the instrument comprising an outer drum shell with one or more ends, one end covered by a drumhead for percussion;

musical strings within the drum shell;

the automatic mechanical tuning system comprising:

tuning cables, tuning dials, sliding plates, pulleys for ease of movement of said tuning cables, said sliding plates, and said tuning dials;

said tuning cables, tuning dials, and sliding plate means for tightening and loosening said drum head and said strings within the drum shell.

20. On a musical instrument comprising an elongate drum shell of substantially circular cross-section the drum shell having a first end and a second end, the first end being covered by a drum head for percussion, a spring housing mountable to the second end for standing the instrument on a floor and comprising:

a central backbone with a striker action for striking musical strings incorporated within the drum shell so as to cause vibratory sound, shock absorbers arranged to absorb impact axial to the drum shell, base extensions for enhancing stability by expanding the instrument's footprint, and pedals for musical note changes.

21. A striker action applicable to a musical instrument, the instrument comprising an outer drum shell with one or more ends for percussion by an object or a hand, the striker action comprising a device with a means for striking musical strings incorporated within the drum shell causing vibratory sound, and for remaining momentarily against the strings for damping vibratory sound.

* * * * *